US012612831B2

(12) United States Patent
Zheng et al.

(10) Patent No.: US 12,612,831 B2
(45) Date of Patent: Apr. 28, 2026

(54) SYSTEMS AND METHODS FOR COILED TUBING DRILLING

(71) Applicant: Schlumberger Technology Corporation, Sugar Land, TX (US)

(72) Inventors: Shunfeng Zheng, Katy, TX (US); Jeremy Murphy, Sugar Land, TX (US); Fei Song, Sugar Land, TX (US); Ke Ken Li, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/752,408

(22) Filed: Jun. 24, 2024

(65) Prior Publication Data

US 2024/0426183 A1 Dec. 26, 2024

Related U.S. Application Data

(60) Provisional application No. 63/509,791, filed on Jun. 23, 2023.

(51) Int. Cl.
*E21B 21/08* (2006.01)
*E21B 17/20* (2006.01)

(52) U.S. Cl.
CPC ..... *E21B 21/08* (2013.01); *E21B 17/20* (2013.01)

(58) Field of Classification Search
CPC ..... E21B 21/08; E21B 17/20
See application file for complete search history.

(56) References Cited

U.S. PATENT DOCUMENTS 2,919,709 A * 1/1960 Schwegman ..... E21B 47/10 166/325
3,040,710 A * 6/1962 Wilder ..... F16K 15/063 175/65
3,954,138 A * 5/1976 Miffre ..... E21B 34/142 137/68.16

(Continued)

FOREIGN PATENT DOCUMENTS

GB 2315508 A 2/1998
WO 2012170273 A1 12/2012

(Continued)

OTHER PUBLICATIONS

SLB, CTDirect Coiled Tubing Directional Drilling System product brochure, 2019, 12 pages.

*Primary Examiner* — Aaron L Lembo
(74) *Attorney, Agent, or Firm* — Jeffrey D. Frantz

(57) ABSTRACT

Systems and methods presented herein facilitate coiled tubing operations, and generally relate to reduction of shock and vibrations to portions of the coiled tubing string. A device includes a first end configured to be disposed downstream of a bottom hole assembly of a coiled tubing drilling string; a second end configured to be disposed downstream of the first end and upstream of a drive of the coiled tubing drilling string; and a moveable valve configured to move from a first position to a second position to divert at least a portion of drilling fluid flow away from the drive when the drilling fluid flow is greater than a preset flow value or a weight on bit is less than a preset weight value and thereby reduce a rotation rate of the drive.

7 Claims, 5 Drawing Sheets

(56) References Cited

U.S. PATENT DOCUMENTS

| | | | | |
|---|---|---|---|---|
| 4,615,399 | A * | 10/1986 | Schoeffler | E21B 41/0078 175/215 |
| 6,854,953 | B2 * | 2/2005 | Van Drentham-Susman | E21B 4/02 415/36 |
| 8,069,926 | B2 | 12/2011 | Eddison | |
| 8,251,155 | B2 * | 8/2012 | Tunc | E21B 41/0035 166/325 |
| 9,145,748 | B1 | 9/2015 | Meier | |
| 10,280,731 | B2 | 5/2019 | Aitken | |
| 10,480,275 | B2 * | 11/2019 | Vander Velde | E21B 33/1208 |
| 10,907,463 | B2 * | 2/2021 | Zheng | E21B 21/08 |
| 11,060,400 | B1 * | 7/2021 | Jamison | G01N 29/022 |
| 11,339,622 | B2 * | 5/2022 | Dubuc | E21B 23/06 |
| 11,619,124 | B2 | 4/2023 | Morrison | |
| 11,808,097 | B2 * | 11/2023 | Morrison | E21B 47/12 |
| 12,000,261 | B2 | 6/2024 | Liu | |
| 12,055,027 | B2 * | 8/2024 | Zheng | E21B 44/02 |
| 12,152,481 | B2 | 11/2024 | Mehta | |
| 2004/0065477 | A1 | 4/2004 | Paulk | |
| 2006/0225885 | A1 | 10/2006 | McGarian | |
| 2007/0151762 | A1 | 7/2007 | Reitsma | |
| 2009/0301734 | A1 | 12/2009 | Tunc | |
| 2014/0110167 | A1 | 4/2014 | Goebel | |
| 2014/0151127 | A1 * | 6/2014 | West | E21B 34/10 175/57 |
| 2016/0024884 | A1 | 1/2016 | Baudoin | |
| 2017/0268324 | A1 | 9/2017 | Moore | |
| 2020/0173268 | A1 | 6/2020 | Zhang, Jr. | |
| 2020/0318471 | A1 | 10/2020 | Papouras | |
| 2021/0140274 | A1 | 5/2021 | Forshaw | |
| 2021/0270097 | A1 | 9/2021 | Ng | |
| 2021/0310342 | A1 | 10/2021 | Marsala | |
| 2022/0251927 | A1 | 8/2022 | Samuel | |
| 2023/0383638 | A1 | 11/2023 | Tayla | |
| 2023/0383646 | A1 | 11/2023 | Yip | |
| 2024/0141758 | A1 | 5/2024 | Al-Mousa | |
| 2024/0287859 | A1 | 8/2024 | Dvorak | |
| 2024/0287860 | A1 | 8/2024 | Su | |
| 2024/0287883 | A1 | 8/2024 | Tardy | |
| 2025/0027402 | A1 | 1/2025 | Abuhaikal | |
| 2025/0084754 | A1 | 3/2025 | Hassig Fonseca | |
| 2025/0084758 | A1 | 3/2025 | Tardy | |

FOREIGN PATENT DOCUMENTS

| | | | |
|---|---|---|---|
| WO | 2022026804 | A1 | 2/2022 |
| WO | 2022271589 | A1 | 12/2022 |
| WO | 2022271591 | A1 | 12/2022 |
| WO | 2022271594 | A1 | 12/2022 |
| WO | 2023077144 | A1 | 5/2023 |
| WO | 2024035758 | A1 | 2/2024 |
| WO | 2024118706 | A1 | 6/2024 |
| WO | 2024151569 | A1 | 7/2024 |
| WO | 2024229316 | A1 | 11/2024 |
| WO | 2024263839 | A1 | 12/2024 |
| WO | 2025096987 | A1 | 5/2025 |
| WO | 2025122527 | A1 | 6/2025 |

* cited by examiner

SYSTEMS AND METHODS FOR COILED TUBING DRILLING

CROSS REFERENCE TO RELATED APPLICATION

This application claims the benefit of, and priority to, U.S. Patent Application No. 63/509,791, filed Jun. 23, 2023, and titled "SYSTEMS AND METHODS FOR COILED TUBING DRILLING," the entirety of which is incorporated herein by reference.

BACKGROUND

The present disclosure generally relates to systems and methods for improving performance of coiled tubing operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many well applications, coiled tubing is employed to facilitate performance of many types of downhole operations. Coiled tubing offers versatile technology due in part to its ability to pass through completion tubulars while conveying a wide array of tools downhole. A coiled tubing system may comprise many systems and components, including a coiled tubing reel, an injector head, a gooseneck, lifting equipment (e.g., a mast or a crane), and other supporting equipment such as pumps, treating irons, or other components. Coiled tubing has been utilized for performing well treatment and/or well intervention operations in existing wellbores such as hydraulic fracturing operations, matrix acidizing operations, milling operations, perforating operations, coiled tubing drilling operations, and various other types of operations.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include systems and methods for automated coiled tubing drilling (CTD) operation in order to improve control of bottom hole pressure, to improve the drilling performance, and to improve response to certain surface and downhole events while reducing the risk of shocks and vibrations to the system, including the bottom hole assembly (BHA), and as well as other undesirable impacts to the system, including the BHA. As part of this automated CTD operation, particular valves, including a flow diversion valve, can be utilized in reducing the level of shock and vibration to the system, including the BHA, during CTD operation while allowing the operation to maintain a desired flow rate during various operations, for example, going off bottom and/or wiper trip operations.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
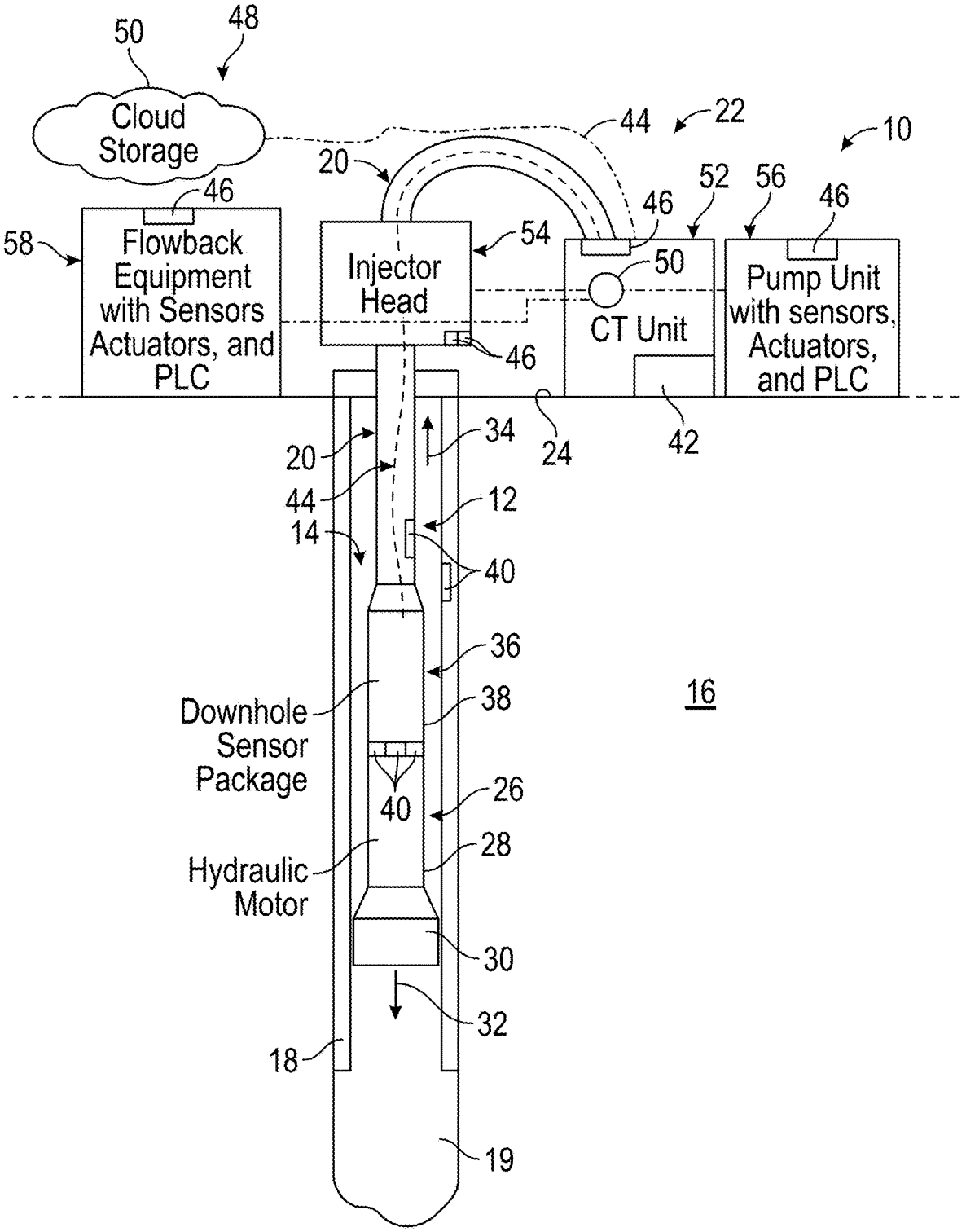
FIG. 1 illustrates a schematic diagram of an example coiled tubing system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a processing system (i.e., solely by the processing system, without human intervention).

Coiled tubing drilling (CTD) can include a coiled tubing unit, a wireline cable going through the coiled tubing for the purpose or providing power and downhole telemetry, a bottom hole assembly (BHA), and underbalanced drilling (UBD) package or managed pressure drilling (MPD) package. The BHA can be made up of, for example, an orienting tool, a measurement while drilling (MWD) tool, a motor or turbine, a drill bit, and other accessories. In some embodiments, these systems (e.g., a coiled tubing system, MPD/UBD package, BHA) are working separately, with different crews working on each individual systems. However, in other embodiments, it can be helpful from a cost and or an ease of use of an operator to combine these systems so that a single control mechanism can manage, for example, the coiled tubing system, MPD/UBD package, and BHA. Without loss of generality, the terms "UBD package", "MPD package" or "Flowback Equipment" are used interchangeably within this document to describe the pressure control equipment in order to maintain a certain bottom hole pressure during the coiled tubing operations.

Compared with conventional drilling, the BHA for coiled tubing drilling experiences more severe downhole shock & vibration. This can be partially attributable to limited weight transfer capability with coiled tubing drilling, flexible nature of the coiled tubing string, as well as the use of nitrified fluid. As a result, the BHA for coiled tubing drilling can suffers more frequent damage, resulting in non-productive time (NPT) where drilling is not performed and, thus, economic loss.

For example, during CTD underbalanced drilling, it has been observed that the CTD BHA experiences significant shock and vibration during going off bottom or wiper trip. The high shock level during the wiper trip can be due to a combination of factors. First, when transitioning from drilling to wiper trip, the torsional energy stored on the whole coiled tubing string should be released, creating a twisting motion on the BHA. In the meantime, so that the bottom hole pressure is maintained, flow rate remains relatively constant. Accordingly, the motor/turbine and the bit will continue to spin. Furthermore, the twisting motion of the coiled tubing and the rotary action of bit creates an unstable situation where the BHA bounces around the wellbore, causing this high level of shock and vibration.

Accordingly, present embodiments provide systems and methods for automated CTD operation with while reducing the risk of shocks to the system, including the bottom hole assembly (BHA), and as well as other undesirable impacts to the system, including the BHA. As part of this automated CTD operation, particular valves, including a flow diversion valve, can be utilized in reducing the level of shock and vibration to the system, including the BHA, during CTD operation while allowing the operation to maintain a desired flow rate during various operations, for example, occurrences of going off bottom and/or wiper trip.

With the foregoing in mind, FIG. 1 illustrates a schematic diagram of an example coiled tubing system 10. As illustrated, in certain embodiments, a coiled tubing string 12 may be run into a wellbore 14 that traverses a hydrocarbon-bearing formation 16 (i.e., reservoir). While certain elements of the coiled tubing system 10 are illustrated in FIG. 1, other elements of the coiled tubing system 10 (e.g., blow-out preventers, wellhead "tree", etc.) may be omitted for clarity of illustration. In certain embodiments, the coiled tubing system 10 includes an interconnection of pipes, including vertical and/or horizontal casings 18, coiled tubing 20, and so forth, that connect to a surface facility 22 at the surface 24 of the coiled tubing system 10. In certain embodiments, the coiled tubing 20 extends inside the casing 18 and terminates at a tubing head (not shown) at or near the surface 24. In certain embodiments, the coiled tubing extends beyond the downhole end of the casing 18, into an openhole section 19 of the wellbore. In addition, in certain embodiments, the casing 18 contacts the wellbore 14 and terminates at a casing head (not shown) at or near the surface 24.

In certain embodiments, a bottom hole assembly (BHA) 26 may be run inside the casing 18 by the coiled tubing 20. As illustrated in FIG. 1, in certain embodiments, the BHA 26 may include a downhole motor 28 that operates to rotate a drill bit 30 (e.g., during drilling operations) or other downhole tools. In certain embodiments, the downhole motor 28 may be driven by hydraulic forces carried in fluid supplied from the surface 24 of the coiled tubing system 10. In certain embodiments, a turbine (not shown) may be used instead of the downhole motor 28 to rotate a drill bit 30. In certain embodiments, the BHA 26 may be connected to the coiled tubing 20, which is used to run the BHA 26 to a desired location within the wellbore 14. It is also contemplated that, in certain embodiments, the rotary motion of the drill bit 30 may be driven by rotation of the coiled tubing 20 effectuated by a rotary table or other surface-located rotary actuator. In such embodiments, the downhole motor 28 may be omitted.

In certain embodiments, the coiled tubing 20 may also be used to deliver fluid 32 to the drill bit 30 through an interior of the coiled tubing 20 to aid in the drilling process and carry cuttings and possibly other fluid or solid components in return fluid 34 that flows up the annulus between the coiled tubing 20 and the casing 18 (or via a return flow path provided by the coiled tubing 20, in certain embodiments) for return to the surface facility 22.

As such, in certain embodiments, the coiled tubing system 10 may include a downhole well tool 36 that is moved along the wellbore 14 via the coiled tubing 20. In certain embodiments, the downhole well tool 36 may include a variety of drilling/cutting tools coupled with the coiled tubing 20 to provide a coiled tubing string 12. In the illustrated embodiment, the downhole well tool 36 includes the drill bit 30, which may be powered by the downhole motor 28 (e.g., a positive displacement motor (PDM), or a turbine, etc.) of the BHA 26. In certain embodiments, the wellbore 14 may be an open wellbore or a cased wellbore defined by the casing 18. In addition, in certain embodiments, the wellbore 14 may be vertical or horizontal or inclined. It should be noted the downhole well tool 36 may be part of various types of BHAs 26 coupled to the coiled tubing 20.

As also illustrated in FIG. 1, in certain embodiments, the coiled tubing system 10 may include a downhole sensor package 38 having multiple downhole sensors 40. In certain embodiments, the sensor package 38 may be mounted along the coiled tubing string 12, although certain downhole sensors 40 may be positioned at other downhole locations in other embodiments. In addition, in certain embodiments, downhole sensors 40 disposed on the coiled tubing 20 may be configured to detect downhole flow rates, downhole temperatures, and downhole pressures, and so forth, in the wellbore 14. In addition, in certain embodiments, downhole sensors 40 disposed on the casing 18 may be configured to detect downhole temperatures, and downhole pressures, and so forth, in the wellbore 14.

In certain embodiments, data from the downhole sensors 40 may be relayed uphole to a surface processing system 42 (e.g., a computer-based processing system) disposed at the surface 24 and/or other suitable location of the coiled tubing system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, electric power may be provided to the BHA via the telemetric control line 44. In certain embodiments, control commands may be sent from the surface to the BHA via the telemetric control line 44. In certain embodiments, the telemetric control line 44 may be in the form of an electrical line, fiber-optic line, or other suitable control line for transmitting data signals. In certain embodiments, the telemetric control line 44 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

As illustrated, in certain embodiments, the coiled tubing 20 may deployed by a coiled tubing unit 52 and delivered downhole via an injector 54 (e.g., an injector head). In certain embodiments, the injector 54 may be controlled to slack off or pick up the coiled tubing 20 so as to control the tubing string weight and, thus, the weight on bit (WOB) acting on the drill bit 30 (or the downhole well tool 36). In certain embodiments, the downhole well tool 36 may be moved along the wellbore 14 via the coiled tubing 20 under control of the injector 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, the data may be used to fully or partially automate downhole operations, to optimize the downhole operations, and/or to provide more accurate predictions regarding components or aspects of the downhole operations.

In certain embodiments, fluid 32 may be delivered downhole under pressure from a pump unit 56. In certain embodiments, the fluid 32 may be delivered by the pump unit 56 through the downhole hydraulic motor 28 to power the downhole hydraulic motor 28 and, thus, the drill bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including the control of the bottom hole pressure.

As described in greater detail herein, the coiled tubing unit 52, the injector 54, the pump unit 56, and the flowback equipment 58 may include advanced surface sensors 46, actuators, and local controllers, such as PLCs, which may cooperate together to provide sensor data to, receive control signals from, and generate local control signals based on communications with, respectively, the surface processing system 42. The local control signals may direct the equipment to operate in certain ways to achieve certain operation objectives, such as to maintain the bottom hole pressure within an allowable pressure window, to maintain certain WOBs during drilling operation, or to control the injector speeds based on certain operation requirements. In certain embodiments, as described in greater detail herein, the surface sensors 46 may include flow rate, pressure, and fluid rheology sensors 46, among other types of sensors. In addition, as described in greater detail herein, the actuators may include actuators for the pump unit 56 and the flowback equipment 58, the injector 54, the coiled tubing stripper (not shown), respectively, among other types of actuators.

In certain embodiments, surface sensors 46 of the coiled tubing unit 52 may be configured to detect positions of the coiled tubing 20, weights of the coiled tubing 20, and so forth. In addition, in certain embodiments, surface sensors 46 of the flowback equipment 58 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluid return rates, solid production rates, gas flow rates, and so forth.

Figure 2:
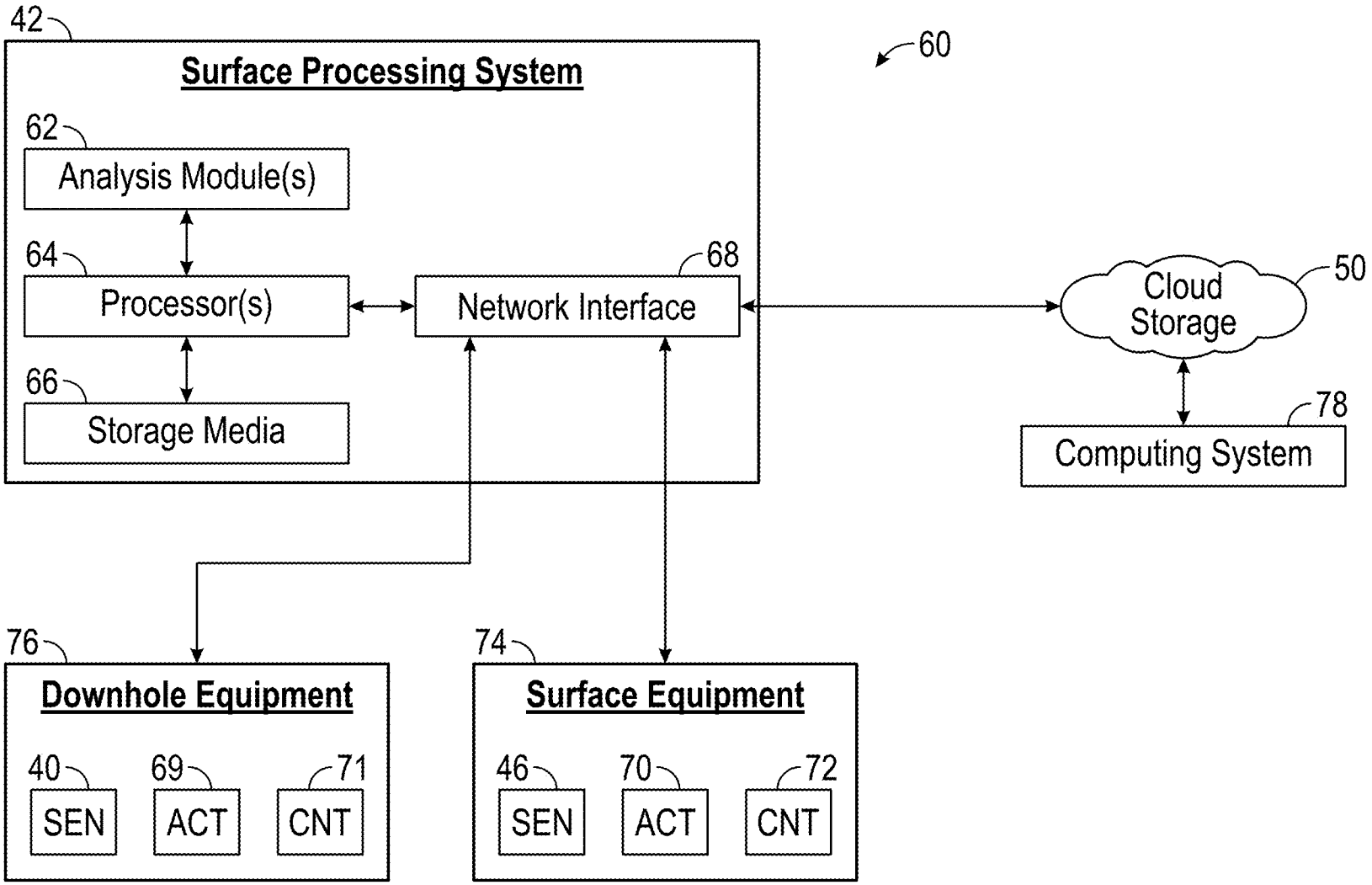
FIG. 2 illustrates a well control system including a surface processing system to control the coiled tubing system of FIG. 1, in accordance with embodiments of the present disclosure.

FIG. 2 illustrates a well control system 60 that may include the surface processing system 42 to control the coiled tubing system 10 described herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, the one or more analysis modules 62 may execute on one or more processors 64 of the surface processing system 42, which may be connected to one or more storage media 66 of the surface processing system 42.

Indeed, in certain embodiments, the one or more analysis modules 62 may be stored in the one or more storage media 66.

In certain embodiments, the computer-executable instructions of the one or more analysis modules 62, when executed by the one or more processors 64, may cause the one or more processors 64 to generate one or more models. Such models may be used by the surface processing system 42 to predict values of operational parameters that may or may not be measured (e.g., using gauges, sensors) during well operations.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more processors 64 may include machine learning and/or artificial intelligence (AI) based processors. The one or more processors 64 may include single-threaded processor(s), multi-threaded processor(s), or both. The one or more processors 64 may process instructions stored in the one or more storage media 66. The one or more processors 64 may also include hardware-based processor(s) each including one or more cores. The one or more processors 64 may include general purpose processor(s), special purpose processor(s), or both. The one or more processors 64 may be communicatively coupled to other internal components (such as the one or more storage media 66, the network interface 68, I/O ports, a display, etc.)

In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

Thus, the one or more storage media 66 may be any suitable articles of manufacture that can serve as media to store processor-executable code, data, or the like. These articles of manufacture may represent computer-readable media (e.g., any suitable form of memory or storage) that may store the processor-executable code used by the one or more processors 64 to perform the presently disclosed techniques. As used herein, applications may include any suitable computer software or program that may be installed onto the surface processing system 42, for example, the one or more analysis modules 62 stored in the one or more storage media 66 to be executed by the one or more processors 64. Thus, the one or more storage media 66 (e.g., memory and/or data storage) may represent non-transitory computer-readable media (e.g., any suitable form of memory or storage) that may store the processor-executable code used by the one or more processors 64 to perform various techniques described herein. It should be noted that non-transitory merely indicates that the media is tangible and not a signal.

In certain embodiments, the processor(s) 64 may be connected to a network interface 68 of the surface processing system 42 to allow the surface processing system 42 to communicate with the multiple downhole sensors 40 and surface sensors 46 described herein, as well as communicate with the actuators 70 and/or controllers 72 of the surface equipment 74 (e.g., the coiled tubing unit 52, the pump unit 56, the flowback equipment 58, and so forth) and the actuators 69 and/or controllers 71 of the downhole equipment 76 (e.g., the BHA 26, the downhole motor 28, the drill bit 30, the downhole well tool 36, and so forth) for the purpose of controlling operation of the coiled tubing system 10, as described in greater detail herein. In certain embodiments, the network interface 68 may also facilitate the surface processing system 42 to communicate data to the cloud storage 50 (or other wired and/or wireless communication network) to, for example, archive the data or to enable an external computing system 78 to access the data and/or to remotely interact with the surface processing system 42. The external computing system 78 can include, a display, a processor communicatively coupled to the display, and a memory communicatively coupled to the processor, the memory storing instructions which, when executed, cause the processor to perform operations comprising generating a graphical user interface (GUI) to allow a user to interact with the computing system 78.

Additionally, in some embodiments, the surface processing system 42 may additionally include I/O ports and/or a display. The I/O ports may be interfaces that may couple to other peripheral components such as input devices (e.g., keyboard, mouse), sensors, input/output (I/O) modules, and the like. The display may operate as a human machine interface (HMI) to depict visualizations associated with software or executable code being processed by the one or more processors 64. The display may display a map of the geological formation data (e.g., images and information derived from the images) corresponding to positions on the map, alerts/alarms when image data is not acceptable, recommendations associated with the alerts/alarms, etc. In one embodiment, the display may be a touch display capable of receiving inputs from an operator of the surface processing system 42. The display may be any suitable type of display, such as a liquid crystal display (LCD), plasma display, or an organic light emitting diode (OLED) display, for example. Additionally, in one embodiment, the display may be provided in conjunction with a touch-sensitive mechanism (e.g., a touch screen) that may function as part of a control interface for the surface processing system 42.

It should be appreciated that the well control system 60 illustrated in FIG. 2 is only one example of a well control system, and that the well control system 60 may have more or fewer components than shown, may combine additional components not depicted in the embodiment of FIG. 2, and/or the well control system 60 may have a different configuration or arrangement of the components depicted in FIG. 2.

In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well-related tools. For example, a variety of data (e.g., downhole data and surface data) may be collected to enable optimization of operations of well-related tools such as the downhole well tool 36 illustrated in FIG. 1 by the surface processing system 42 illustrated in FIG. 2 (or other suitable processing systems). In certain embodiments, the data may be provided as advisory data by the surface processing system 42 (or other suitable processing systems) and can lead to human interaction based on the data. However, in other embodiments, the data may be used to facilitate automation of downhole processes and/or surface processes (i.e., the processes may be automated without human intervention), as described in greater detail herein, by the surface processing system 42 (or other suitable processing system). The embodiments described herein may enhance downhole operations by improving the efficiency and utilization of data to enable performance optimization and improved resource controls.

As described in greater detail herein, in certain embodiments, downhole parameters may be obtained via, for example, downhole sensors 40 while the downhole well tool 36 is disposed within the wellbore 14. In certain embodiments, the downhole parameters may be obtained in substantially real time and sent to the surface processing system 42 via wired or wireless telemetry. In certain embodiments, downhole parameters may be combined with surface parameters by the surface processing system 42. In certain embodiments, the downhole and surface parameters may be processed by the surface processing system 42 during use of the downhole well tool 36 to enable automatic (e.g., without human intervention) optimization with respect to use of the downhole well tool 36 during subsequent stages of operation of the downhole well tool 36.

Non-limiting examples of downhole parameters that may be sensed in substantially real time include, but are not limited to, weight on bit (WOB), torque acting on the downhole well tool 36, downhole pressures, downhole differential pressures, toolface, shock and vibration, and other desired downhole parameters. In certain embodiments, downhole parameters may be used by the surface processing system 42 in combination with surface parameters, and such surface parameters may include, but are not limited to, pump-related parameters (e.g., pump rate and circulating pressures of the pump unit 56). In certain embodiments, the surface parameters also may include parameters related to fluid returns (e.g., wellhead pressure, return fluid flow rate, choke settings, returned gas flow rate, and other desired surface parameters). In certain embodiments, the surface parameters also may include data from the coiled tubing unit 52 (e.g., surface weight of the coiled tubing string 12, speed of the coiled tubing 20, rate of penetration, and other desired parameters). In certain embodiments, the surface data that may be processed by the surface processing system 42 to optimize performance also may include previously recorded data.

In certain embodiments, use of the downhole data and surface data enables the surface processing system 42 to self-learn (e.g., modeling or simulation using the machine learning or artificial intelligence (AI) based processors, machine learning or AI based algorithms stored in the one or more storage media 66, or a combinations thereof). This real-time modeling by the surface processing system 42, based on the downhole and surface parameters, enables improved downhole operations. Such modeling by the surface processing system 42 also enables the downhole process to be automated and automatically optimized by the surface processing system 42. For instance, the modeling based on the downhole parameters may be used by the surface processing system 42 to predict wear on the downhole motor 28 and/or the drill bit 30, and to advise as to timing of the next trip to the surface for replacement of the downhole motor 28 and/or the drill bit 30.

For example, downhole data such as WOB, torque data from a load module associated with the downhole well tool 36, and bottom hole pressures (internal and external to the bottom hole assembly 26/downhole well tool 36) may be processed via the surface processing system 42. The processed data may then be utilized by the surface processing system 42 to control the injector 54 to generate, for example, a faster and more controlled rate of penetration (ROP). Additionally, the processed data may be updated by the surface processing system 42 as the downhole well tool 36 is moved to different positions along the wellbore 14 to help optimize operations. The processed data also enables automation of the downhole process through automated controls over the injector 54 via control instructions provided by the surface processing system 42.

In certain embodiments, data from downhole may be combined by the surface processing system 42 with surface data received from injector 54 and/or other measured or stored surface data. By way of example, surface data may include hanging weight of the coiled tubing string 12, speed of the coiled tubing 20, wellhead pressure, choke and flow back pressures, return pump rates, circulating pressures (e.g., circulating pressures from the manifold of a coiled tubing reel in the coiled tubing unit 52), and pump rates. The surface data may be combined with the downhole data by the surface processing system 42 with in real time to provide an automated system that self-controls the injector 54. For example, the injector 54 may be automatically controlled (e.g., without human intervention) to optimize ROP under direction from the surface processing system 42.

In certain embodiments, data from drilling parameters (e.g., surveys and pressures) as well as fracturing parameters (e.g., volumes and pressures) may be combined with real-time data obtained from sensors 40, 46. The combined data may be used by the surface processing system 42 in a manner that aids in machine learning and/or artificial intelligence to automate subsequent jobs in the same well and/or for neighboring wells. The accurate combination of data and the updating of that data in real time helps the surface processing system 42 improve the automatic performance of subsequent tasks.

In certain embodiments, depending on the type of operation downhole, the surface processing system 42 may be programmed with a variety of algorithms and/or modeling techniques to achieve desired results. For example, the downhole data and surface data may be combined and at least some of the data may be updated in real time by the surface processing system 42. This updated data may be processed by the surface processing system 42 via suitable algorithms to enable automation and to improve the performance of, for example, downhole well tool 36. By way of example, the data may be processed and used by the surface processing system 42 for preventing motor stalls. In certain embodiments, downhole parameters such as forces, torque, and pressure differentials may be combined by the surface processing system 42 to enable prediction of a next stall of the downhole motor 28 and/or to give a warning to a supervisor. In such embodiments, the surface processing system 42 may be programmed to make self-adjustments (e.g., automatically, without human intervention) to, for example, speed of the injector 54 and/or pump pressures to prevent the stall, and to ensure efficient continuous operation.

In addition, in certain embodiments, the data and the ongoing collection of data may be used by the surface processing system 42 to monitor various aspects of the performance of downhole motor 28. For example, motor wear may be detected by monitoring the effective torque of the downhole motor 28 based on data obtained regarding pump rates, pressure differentials, and actual torque measurements of the downhole well tool 36. Various algorithms may be used by the surface processing system 42 to help a supervisor on site to predict, for example, how many more hours the downhole motor 28 may be run efficiently. This data, and the appropriate processing of the data, may be used by the surface processing system 42 to make automatic decisions or to provide indications to a supervisor as to when to pull the coiled tubing string 12 to the surface to replace the downhole motor 28, the drill bit 30, or both, while avoiding unnecessary trips to the surface.

In certain embodiments, downhole data and surface data also may be processed via the surface processing system 42 to predict a time when the coiled tubing string 12 may become stuck. The ability to predict when the coiled tubing string 12 may become stuck helps avoid unnecessary short trips and, thus, improves coiled tubing operation efficiency. In certain embodiments, downhole parameters such as forces, torque, and pressure differentials in combination with surface parameters such as weight of the coiled tubing 20, speed of the coiled tubing 20, pump rate, and circulating pressure may be processed via the surface processing system 42 to provide predictions as to the time when the coiled tubing 20 will become stuck. Based on coiled tubing stuck prediction or detection, a controller may be implemented to automatically execute certain operations sequences, such as changing injector speed profile, changing pump rates, etc., to mitigate the probability of coiled tubing stuck. Using the sensor data from both the surface sensors 46 and downhole sensors 40, similar controllers can be implemented to detect other undesirable surface and downhole events, such as bridge, coiled tubing runaway, etc. and to command relevant equipment to react automatically to prevent operation failures.

In certain embodiments, the surface processing system 42 may be designed to provide warnings to a supervisor and/or to self-adjust (e.g., automatically, without human intervention) either the speed of the injector 54, the pump pressures and rates of the pump unit 56, or a combination of both, so as to prevent the coiled tubing 20 from getting stuck based on the predictions described herein. By way of example, the warnings or other information may be output to a display of the surface processing system 42 to enable an operator to make better, more informed decisions regarding downhole or surface processes related to operation of the downhole well tool 36. In certain embodiments, the speed of the injector 54 may be controlled via the surface processing system 42 by controlling the slack-off force from the surface. In general, the ability to predict and prevent the coiled tubing 20 from becoming stuck substantially improves the overall efficiency, and helps avoid unnecessary short trips if the probability of the coiled tubing 20 getting stuck is minimal. Accordingly, the downhole data and surface data may be used by the surface processing system 42 to provide advisory information and/or automation of surface processes, such as pumping processes or other processes.

As noted above, CTD can sometime experience situations in which shock, for example, to the BHA occurs. For example, during the operation steps of pull test, wiper trip, or simply going off bottom, shocks and/or vibrations to the system, including the BHA 26, can occur with such severity that, for example, the BHA 26 can suffer more frequent damage, resulting in NPT. To remedy this occurrence, i.e., to reduce the severity of shocks and/or vibrations to the BHA, various techniques and devices can be employed. In one embodiment, a method to reduce the severity of shocks and/or vibrations in CTD operations is described in conjunction with FIG. 3.

Figure 3:
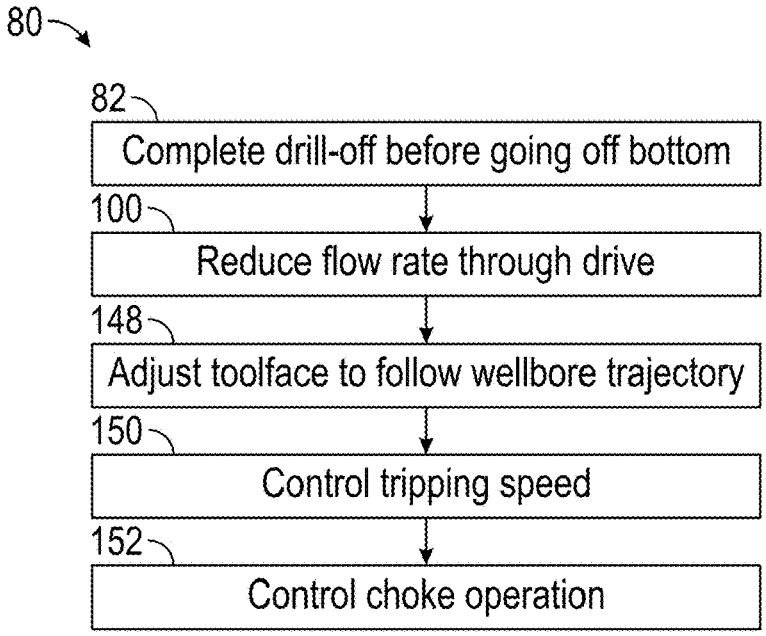
FIG. 3 illustrates a flowchart of a method for performing a coil tubing drilling operation, in accordance with embodiments of the present disclosure.

FIG. 3 is a flowchart of a computer-implemented method 80 to facilitate underbalanced coiled tubing drilling while minimizing damage to the BHA 26 through automating the drilling process. It should be noted that FIG. 3 represents a method of automating CTD operations. In some embodiments, method 80 can be performed via control architecture for the present invention, as described in FIG. 2. Real time data can be acquired from both the BHA 26 and surface equipment 74 (i.e. injector 54, pump unit 56, choke, etc.) and passed on to an orchestrator (e.g., the surface processing system 42). Additionally, an operator's command may be received by the orchestrator (e.g., the surface processing system 42), and dispatched to, for example, the surface equipment 74 and/or the downhole equipment 76 in conjunction with one or more steps of the method 80.

At step 82 of method 80, completion of drill-off is accomplished before going off bottom is undertaken. As part of step 82, it may be desirable to complete the drill-off process to release the torsional energy stored on the coiled tubing 20 prior to the start of a wiper trip. Indeed, during drilling phase, due to WOB and torque on bit (TOB), as well as the friction between the wellbore 14 and the coiled tubing 20, the coiled tubing 20 (e.g., coiled tubing string) is subjected to both torque and compression. Due to the length of the coiled tubing 20, torsion energy dominates the energy stored in the string of coiled tubing. The stored torsional energy, in conjunction with the stored compression energy, can be substantially released by completing the drill-off before going off bottom (e.g. performing a wiper trip, weight check, etc. operation). Operationally, the driller could manually monitor the downhole WOB and TOB. Thereafter, wiper trip could be commenced when both WOB and TOB are substantially close to zero.

Figure 4:
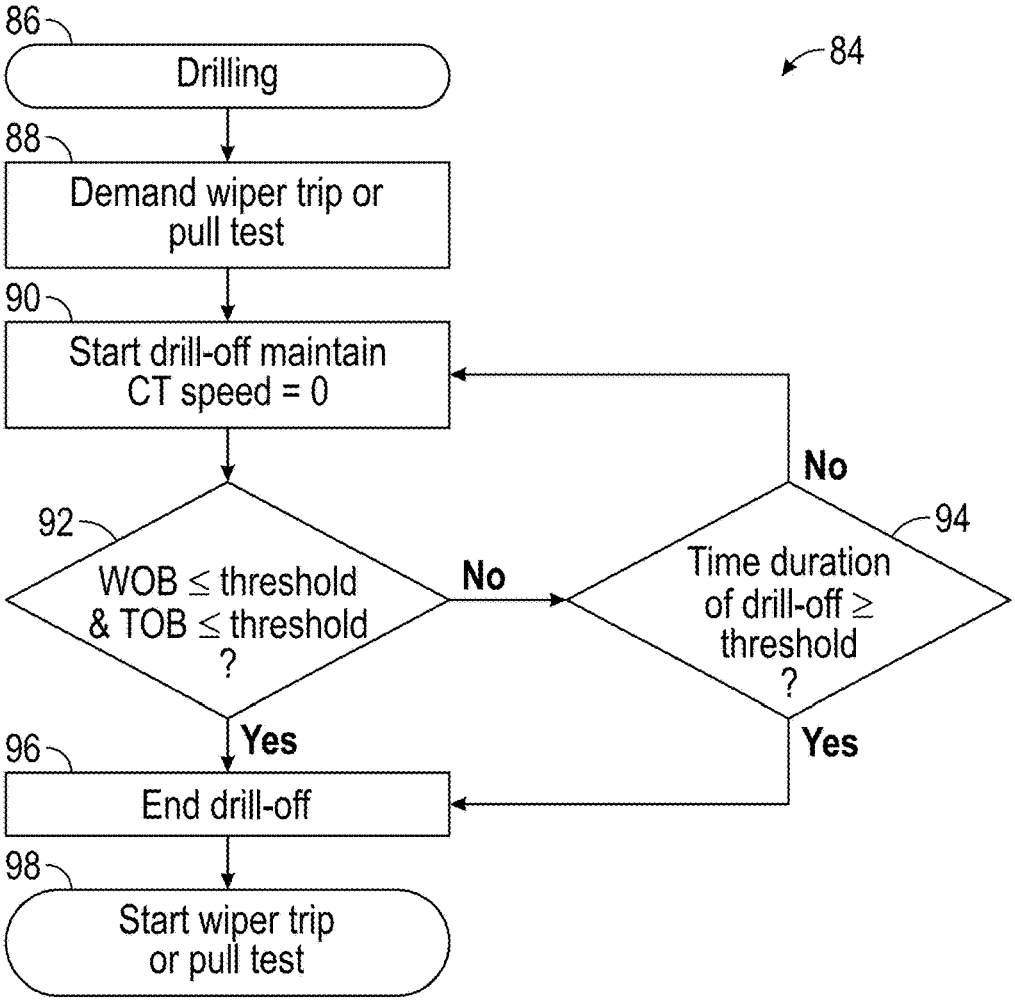
FIG. 4 illustrates a flowchart of a method for performing the completing drill-off step of the method illustrated in FIG. 3, in accordance with embodiments of the present disclosure.

In another embodiment, a CTD controller could be designed to automate the going off bottom process. This controller could be, for example, implemented in a controller 72 of the injector 54 and could operate to monitor the value of WOB and TOB, such that when one or both of WOB and TOB are substantially close to a threshold value (e.g., zero), the wiper trip can be initiated as a portion of step 82. FIG. 4 illustrates a flowchart of a method 84 to automate the going off bottom process of step 82.

As illustrated in FIG. 4, in step 86 of method 84, a drilling operation is being undertaken. At step 88, a demand for a wiper trip and/or a pull test is issued by the driller. In response to this command, in step 90, the drill-off operation may begin. As part of step 90, the speed of the coiled tubing can be maintained at a set value, for example, zero. With respect to method 84, drill-off can be considered as completed when any one of the following two criterions is met. First, in step 92, the controller receives an indication of the WOB and the TOB. These indications may be data signals transmitted from one or more of the downhole sensors 40. The controller can determine whether one or more of the WOB and the TOB is less than a threshold value or less than or equal to a threshold value. If one or more of these conditions are not met, method 84 proceeds to step 94.

In step 94, the controller determines whether a duration of the drill-off is less than a threshold value or less than or equal to a threshold value (i.e., a timing threshold value measuring a predetermined amount of time). If the threshold value is not met, method 84 repeats the checking process from steps 90 and 92. Alternatively, if the threshold value is met in step 94, the drill-off operation is determined to be completed in step 96. Similarly, if in step 92, the controller determines that one or more of the WOB and the TOB is less than a threshold value or less than or equal to a threshold value, the drill-off operation is determined to be completed in step 96. Thereafter, a wiper trip of pull test can be performed, as illustrated in step 98. The drill-off process, as described in FIG. 4, may be implemented as a controller within the PLC of the injector 54 or as a controller within the surface processing system 42 in FIG. 2.

Returning to FIG. 3, once the wiper trip from step 98 of FIG. 4 commences, it may be beneficial to prescribe a certain speed profile for the duration of the wiper trip utilizing, for example, the surface processing system 42. Thus, in step 100, the surface processing system 42 can transmit a control signal to reduce the flow of fluid 32 through downhole motor 28 (or turbine) so as to reduce the revolutions per minute (RPM) during the tripping operation. In some embodiments, this may be accomplished via the use of a downhole tool, such as a circulation sub, that is used to control the amount of flow rate through the motor 28. Indeed, in addition to releasing the torsional energy, the shock and vibration level on the CTD can be further reduced when combined with a downhole tool, such as a circulation sub, which can be controlled by flow rate, by an electrical signal from the surface 24, or simply by WOB. In some embodiments, in step 100, when the wiper trip starts, the flow rate through the motor 28 (or turbine) is reduced, based on the configuration of the circulation sub, for example, to 50% of the typical flow rate for drilling, while maintaining the same surface 24 pump rate (to maintain the desired hole cleaning objectives). In this manner, shock and/or vibration on the BHA 26 can be further reduced. The wiper trip process as described in FIG. 3, in conjunction with the drill-off process, may be implemented as an automated process within the surface processing system 42 in FIG. 2.

Figure 5:
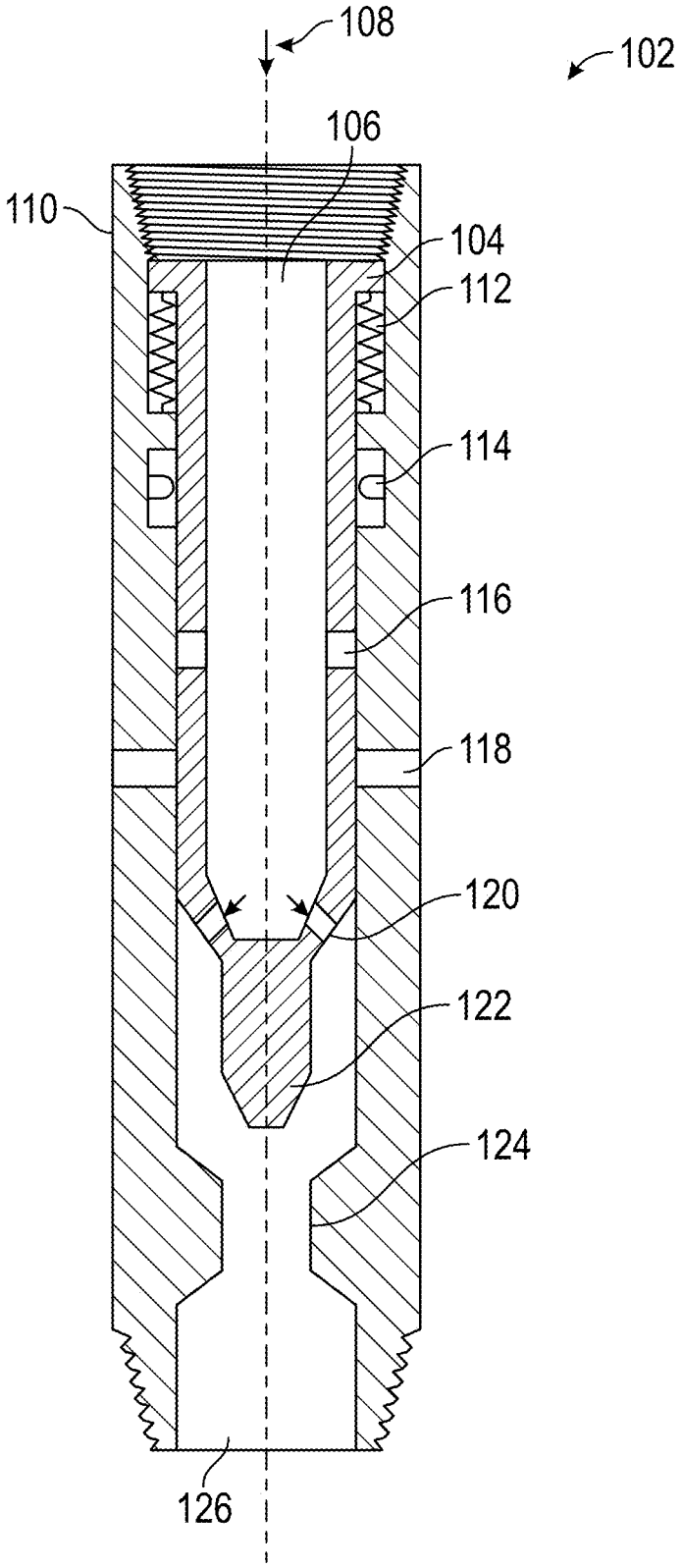
FIG. 5 illustrates a flow diversion valve useable in conjunction with the reducing of flow rate step of the method illustrated in FIG. 3, in accordance with embodiments of the present disclosure.

FIG. 5 illustrates an example of one type of downhole tool utilized as a circulation sub. In one embodiment, this downhole tool can be a circulation valve and the downhole tool can be disposed directly above the downhole motor 28 (or turbine) or anywhere between the drive (e.g., the downhole motor 28 or turbine) and the endo of the coiled tubing 20).

More particularly, FIG. 5 illustrates a downhole tool 102 that can operate as a circulation sub. The downhole tool 102 can be, for example, part of the downhole well tool 36 or may operate as the downhole well tool 36. As illustrated, the downhole tool 102 includes a piston 104 having a central region 106 disposed therein through which a fluid can flow as illustrated by flow 108. The piston 104 is surrounded by an outer mandrel 110 and in operation, the piston 104 can move vertically (along the axis illustrated in conjunction with flow 108) with respect to the outer mandrel 110. Thus, the downhole tool 102 can include an outer mandrel 110, with its top end (e.g., box end) connecting to a lower end of a MWD tool, and its bottom end (e.g., pin end) connecting to a drive (e.g., downhole motor 28 or turbine).

The downhole tool 102 also includes a biasing element 112, such as a spring, that operates to resist movement of the piston 104 in the same vertical direction as flow 108 as well as to cause vertical movement of the piston 104 in the opposite vertical direction as flow 108. The downhole tool further includes one or more J-slots 114 that are used in the setting and unsetting of the piston 104. Thus, the biasing element 112 is placed between the piston 104 and the outer mandrel 110, which allows the piston 104 to slide longitudinally (or axially) when flow rate changes. Furthermore, the J-slot 114 mechanism is placed between the piston 104 body and the outer mandrel 110, which can lock the piston 104 at different heights relative to the outer mandrel 110 with the changes in flow rate.

Further illustrates in the piston 104 is one or more ports 116 that operate as openings to vent the fluid passing through the piston 104 in conjunction with the flow 108 when the piston 104 is activated and moved to a downward position (relative to the initial position of the piston 104 illustrated in FIG. 5). Also present in the downhole tool 102 is one or more ports 118 in the outer mandrel 110 that operate as openings to vent the fluid passing through the piston 104 in conjunction with the flow 108 when the piston 104 is activated and moved to a downward position (relative to the initial position of the piston 104 illustrated in FIG. 5). That is, when the piston 104 is activated and moved to a downward position (relative to the initial position of the piston 104 illustrated in FIG. 5), the one or more ports 116 align with the one or more ports 118 to vent a portion, for example, approximately 50%, 60%, 70%, 80%, 90%, or 100% of the fluid entering the piston 104. Thus, within the piston 104, there are a plurality of radial ports (ports 116) and within the outer mandrel 110, there are also a corresponding number of radial ports (ports 118). When the ports 116 are aligned with the ports 118, at least a portion of fluid flowing through the piston 104 will exit out of the outer mandrel 110, without further traveling down toward the drive (e.g., the downhole motor 28 or a turbine).

Also illustrated in the piston 104 of FIG. 5 are one or more ports 120 through which the fluid may pass when the piston 104 is deactivated (positioned in the initial position of the piston 104 as illustrated in FIG. 5). The piston 104 may further include a plug 122, which can connect to the piston 104 body through a plurality of fingers, whereby the plug operates to contact a plug seat 124 of the downhole tool 102 when the piston 104 is activated and moved to a downward position (relative to the initial position of the piston 104 illustrated in FIG. 5). The space between the fingers, or within the fingers, can include ports 120, which allow fluid to travel down toward the drive (e.g., downhole motor 28 or turbine) when the piston is deactivated. However, when the piston 104 is so activated, the plug 122 and plug seat 124 operate to restrict a portion or all of the fluid transmitted along flow 108 (i.e., operate as a partial or full seal, depending on design). For example, the plug and plug seat when in contact can restrict fluid, for example, restrict fluid transmission thru an end portion 126 of the piston to approximately 50%, 40%, 30%, 20%, 10%, or 0% of the fluid entering the piston 104. In this manner, the downhole tool 102 can be controlled to restrict fluid flowing to the drive (e.g., the downhole motor 28 or turbine) to reduce the RPM thereof.

Thus, during many drilling operation, ports 116 do not align with ports 118 and fluid travel through the central region 106 of the piston 104 toward the drive, and exit the drill bit 30. However, during the operations of going off bottom or wiper trip, by temporarily increasing the flow rate to a preset value, the pressure differential across the piston 104 will overcome the biasing element 112 (e.g., the spring force), and push the piston 104 downward, thereby aligning ports 116 with ports 118. This causes at least a portion of the fluid in the central region 106 of the piston 104 to exit to the outer mandrel 110. At the same time, with the downward movement of the piston 104, the J-slot 114 mechanism is activated, and can lock in a position that will maintain the relative position of the piston 104 and outer mandrel 110.

The downward movement of the piston 104 also causes the piston plug 122 to move close to the plug seat 124 on the outer mandrel 110, further reducing/throttling the flow toward the drive. Reduction in the flow toward the drive will reduce the shock and vibration the BHA 26 experiences. Once the downhole tool 102 (e.g., circulation valve) is activated to divert some fluid to exit the outer mandrel 110, flow rate may be reduced to the desired value to continue the operations (e.g., going off bottom/wiper trip). To reset the downhole tool 102 for a drilling mode, the flow rate may be temporarily increased to a preset value and then reduced to a normal value below the present value. This will cause the J-slot 114 mechanism to be shifted, resulting in the ports 116 moving away from the ports 118. This corresponds to a shutting off the flow exiting the outer mandrel 110 which results in all fluid flowing through the downhole tool 102 into the drive for a normal drilling operation.

In some embodiments, when activated, the percentage of flow exciting the outer mandrel 110 (e.g., to the annulus between the coiled tubing 20 and the casing 18) can be adjusted. For example, the percentage of flow can be set by designing the J-slot 114 pattern in a way that causes partial to full alignment between the ports 116 and the ports 118. In another embodiment, the percentage of flow exciting the outer mandrel 110 (e.g., to the annulus between the coiled tubing 20 and the casing 18) can be adjusted by installing different size of orifices on the ports 118 (e.g., at the surface 24 before inserting the downhole tool 102 into the wellbore 14).

Figure 6:
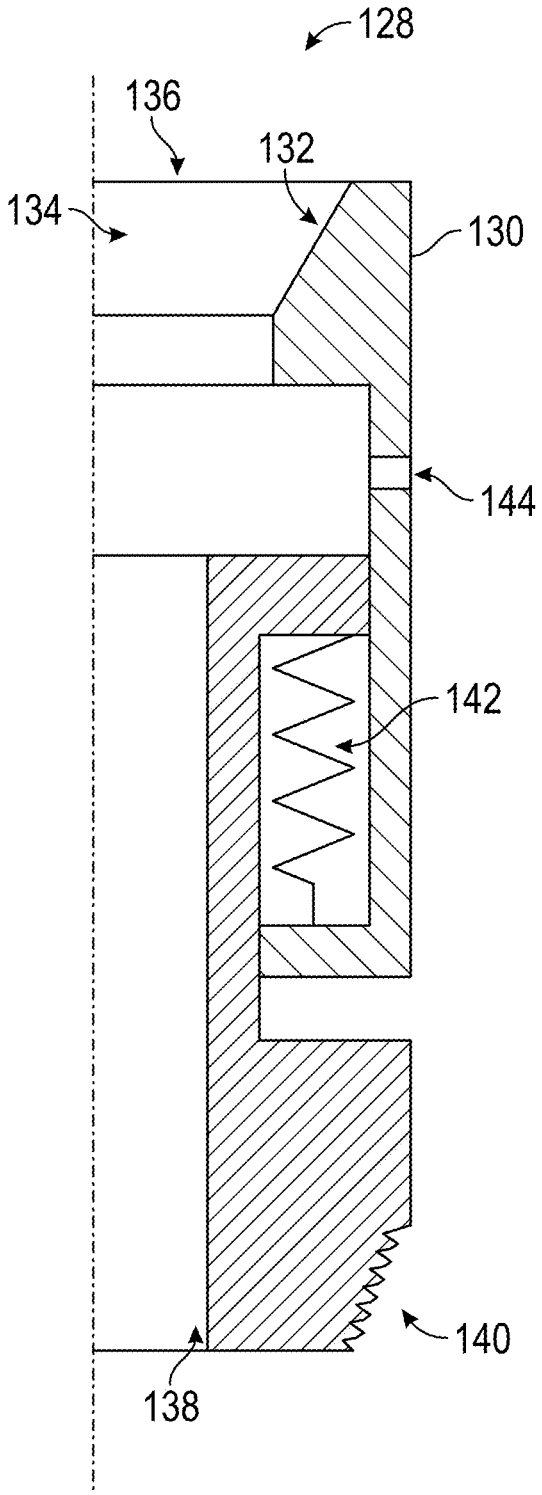
FIG. 6 illustrates a circulation valve useable in conjunction with the reducing of flow rate step of the method illustrated in FIG. 3, in accordance with embodiments of the present disclosure.

It should be noted that other embodiments of a downhole tool utilized as a circulation sub can be implemented in place of the downhole tool 102 of FIG. 5. For example, FIG. 6 illustrates a downhole tool 128. In one embodiment, this downhole tool 128 can be a compression activated circulation valve and the downhole tool can be disposed directly above the downhole motor 28 (or turbine) or anywhere between the drive (e.g., the downhole motor 28 or turbine) and the endo of the coiled tubing 20).

The downhole tool 128 includes an upper mandrel 130 having an upper connection 132. The upper connection 132 can form a central region 134 disposed therein through which a fluid can flow as illustrated by flow 136. The downhole tool 128 also includes a lower mandrel 138 having a lower connection 140. The lower connection 140 further defines the central region 134 disposed therein through which a fluid can flow as illustrated by flow 136. The lower mandrel 138 with the lower connection 140 can operate to connect to the downhole end of the BHA 26 (e.g. the drive as the downhole motor 28 or a turbine). Additionally, a biasing element 142 (e.g., a spring) is present and is disposed in between the lower mandrel 138 and the upper mandrel 130. Finally, the downhole tool 128 can include ports 144 disposed in the upper mandrel 130 that, as described below, can operate to provide a path to flow exciting the upper mandrel 130 (e.g., to the annulus between the coiled tubing 20 and the casing 18).

In operation, such as during a no drilling operation (e.g., tripping, wiper trip, etc.), the ports 144 are exposed to the incoming fluid along flow 136. Depending on the size of the ports 144, a portion of flow 136 (e.g., approximately 50%, 60%, 70%, 80%, 90%, or 100% of the fluid entering the downhole tool 128) is diverted through the ports 144 to, for example, an annulus between the coiled tubing 20 and the casing 18), while the rest of the flow 136 (e.g., approximately 50%, 40%, 30%, 20%, 10%, or 0% of the fluid entering the downhole tool 128) travels downstream through downhole tool and to the drive (e.g., the downhole motor 28 or turbine). Additionally, during drilling, WOB is applied and the lower mandrel 138 moves upward relative to the upper mandrel 130, blocking the ports 144. As a result, all or a substantial portion of the flow 136 (e.g., approximately 50%, 60%, 70%, 80%, 90%, or 100% of the fluid entering the downhole tool 128) will go through downhole tool 128 and will be provided to the drive while none or a reduced portion of the flow (e.g., approximately 50%, 40%, 30%, 20%, 10%, or 0% of the fluid entering the downhole tool 128) will be diverted through the ports 144 to, for example, an annulus between the coiled tubing 20 and the casing 18).

In some embodiments, the downhole tool 128 is a pure mechanical circulation valve, with activation and control of flow diversion amount through changes in flow rate. However, in other embodiments, a different circulation valve as the downhole tool 128 can be implemented with finer control of the activation and/or the amount of flow diversion, for example, utilizing the power and electronics that are available on to the BHA 26.

In this manner, FIGS. 5 and 6 illustrate respective downhole tool 102 and downhole tool 128 as examples of devices that can be implemented to accomplish the reduction in the RPM of the drive (e.g., downhole motor 28 or turbine) of step 100 in FIG. 3. In addition to releasing the torsional energy, the shock and vibration level on the CTD can be further reduced when combined with downhole tool 102 or downhole tool 128 (e.g., a circulation sub). As described above, the downhole tool 102 and/or downhole tool 128 can be controlled by flow rate. However, in other embodiments, the downhole tool 102 and/or downhole tool 128 can instead be controlled by electrical signals from the surface 24, or simply by WOB. Regardless, when wiper trip starts, the flow rate through the drive (e.g., the downhole motor 28 or turbine) is reduced, based on the configuration of the downhole tool 102 or downhole tool 128 to a predetermined value, for example, 50% of the typical flow rate for drilling, while maintaining the same surface 24 pump rate (to maintain the desired hole cleaning objectives). In this manner, shock and/or vibration on the BHA 26 are further reduced.

Returning to FIG. 3, once step 100 has been completed, the method 80 proceeds to step 148. In step 148, automatic adjustment of the toolface may be undertaken. For example, the toolface can be adjusted to be on a low side (e.g., between approximately 120-280 degrees, for example, approximately 120 degrees, approximately 130 degrees, approximately 140 degrees, approximately 150 degrees, approximately 160 degrees, approximately 170 degrees, approximately 180 degrees, approximately 190 degrees, approximately 200 degrees, approximately 210 degrees, approximately 220 degrees, approximately 230 degrees, approximately 240 degrees, approximately 250 degrees, approximately 260 degrees, approximately 270 degrees, approximately 280 degrees, between approximately 120 degrees and approximately 180 degrees, between approximately 150 degrees and approximately 210 degrees, between approximately 180 degrees and approximately 240 degrees, between approximately 200 degrees and 280 degrees, or another value) prior to the onset of the wiper trip. In some embodiments, this action can be performed manually prior to the wiper trip. Alternatively, as part of the process control, this action can be programmed via the controller (e.g., a controller 71 of the downhole equipment 76) such that when the driller issues a wiper trip command, the tool face is automatically adjusted to the low side prior to commencement of the wiper trip operation.

Instead of setting the toolface to the low side of the wellbore 14, a preferred embodiment in step 148 of FIG. 3 is to actively adjust the toolface such that it is aligned with the wellbore 14 trajectory during the whole wiper trip process. In step 148, adjustment (i.e., control) of the toolface to follow the trajectory of the wellbore 14 during tripping is performed. The CTD BHA 26 usually includes a bend sub with a bend angle, typically between approximately 1 and 5 degrees. During a tripping operation (i.e., tripping-in or tripping-out), severe vibrations may occur on the BHA 26. This can cause damage to, for example, the electronics of the BHA 26. Step 148 can operate to mitigate the vibration by adjusting (controlling) the toolface angle to be aligned with the wellbore 14, which will minimize the interference between the bend sub and the wellbore 14. This reduces the severity of downhole vibration. In some embodiments, to automate the orientation of the toolface to follow the wellbore 14 trajectory, the orchestrator can maintain a toolface history (e.g., vs depth) as the well is drilled. During tripping, the orchestrator monitors the depth, and issue commands to turn the toolface to follow the toolface on record. This way, the BHA 26 will follow the trajectory of the wellbore during tripping. The process can automatically performed by the orchestrator as the subsurface processing system 42. This process requires the coordination of controllers between the BHA 26 and the injector 54 and may be implemented in the surface processing system of 42 in FIG. 2.

During coiled tubing 20 tripping (tripping in or tripping out), an automated controller could be implemented on (or with) the surface processing system 42 to provide a cruise control feature (i.e., to maintain certain tripping speed). The automated controller could be configured in a way to automatically adjust the cruise control speed when the BHA 26 approaches a downhole restriction, and resume to normal cruise control speed when the BHA 26 passes the restriction. Furthermore, the automated controller could be used to coordinate the control of injector 54 (e.g., for tripping speed), the control of mud pumps (e.g., for flow rates of fluid and/or nitrogen), and/or the control of flowback equipment 58 (e.g., choke position) to maintain a target bottomhole pressure. In some embodiments, during a tripping out operation, the automated controller can operate based on, for example, a nitrified fluid (e.g., a determined partial fraction of nitrogen) and the control of the speed of the coiled tubing 20 tripping speed can operate to, for example, minimize explosive decompression for mud motor. In many underbalanced CTD operation, nitrogen is typically used to create the underbalanced condition. Depending on wellbore condition, high partial fraction of nitrogen, typically 50% or above, may be used. However, in some embodiments, the high partial fracture of nitrogen can cause damage to the elastomer in the systems or devices, for example, the mud motor. This damage can be a result of explosive decompression of rubber in the mud motor. One way to mitigate this elastomer damage is to control the speed of the coiled tubing 20 tripping speed during a tripping operation (e.g., tripping-out). The coiled tubing 20 tripping speed can be controlled, for example, based on the downhole pressure (BHP) measurement to ensure that pressure gradient (i.e., pressure change over time) during tripping out is maintained within an acceptable threshold.

During underbalanced drilling operation, it can be advantageous to maintain bottomhole pressure within an acceptable (i.e., desired or predetermined) window during all phases of coiled tubing drilling operation. Maintaining bottomhole pressure to a targeted window can be accomplished, for example, by coordinating the operation of mud pumps, injector 54, flowback equipment 58, etc., based on the surface sensor 46 data and downhole sensor 40 data. To illustrate the process, consider the wiper trip operation as shown on FIG. 3. As additionally illustrated in FIG. 3, step 152 of method 80 includes the control of an underbalanced drilling (UBD) choke. This control can automatic (e.g., a controller 71 of the downhole equipment 76 controlled by the surface processing system 42). In some embodiments, the control can be based on, for example, the real time BHP measurement. With the real time BHP measurement from the BHA 26, a controller automatically operates the UBD choke and other surface equipment (i.e. injector 54, pump unit 56, etc.) in order to maintain an desired (e.g., optimal) bottom hole pressure. The controller can operate by utilizing, for example, the fluid and/or solid processing capability of the UBD system, the compressibility of the fluid in the wellbore 14, and or other inputs and can automatically issue a command to operate chokes, the coiled tubing 20 injector (e.g., injector 54), pumps (e.g., pump unit 56), nitrogen rate, etc. to achieve the control objectives. In this manner, the method 80 operates to facilitate underbalanced coiled tubing drilling while minimizing damage to the BHA 26 during particular downhole conditions via automating the drilling process.

In this manner, an automated coiled tubing drilling system and method is provided herein, which includes coiled tubing equipment, a wireline cable (e.g., telemetric control line 44) passing through the coiled tubing 20, flowback control equipment, a BHA 26, and a surface processing system 42 (or "automation server"). Additionally, a circulation valve (e.g., a circulation sub) may also be utilized to adjust fluid flow rates to a drive of the coiled tubing drilling system. Based on surface and downhole data (e.g., data received from the BHA 26), automation of the operation of the drilling system can be employed to maintain a desired ROP, WOB, or pressure differential.

Additionally, in some embodiments, based on surface and downhole data, the surface processing system 42 can operate to automatically detect undesirable drilling events (such as stuck event, bridge, coiled tubing running away, etc.), and without human intervention, automatically respond to mitigate or avoid such undesirable events. In this manner, the drilling system can automatically respond to an adverse event. Furthermore, the surface processing system 42, based on surface and downhole data, can operate to automatically send out commands to the surface equipment (such as injector 54), and the downhole BHA 26 via the wireline cable (e.g., telemetric control line 44), to coordinate the control of surface equipment and downhole BHA 26. In some embodiments, these commands operate to coordinate controls between surface and downhole equipment to mitigate shock and vibration, for example, on the BHA 26.

Furthermore, in some embodiments, the surface processing system 42, based on the surface and downhole data, can operate to automatically send out commands to different surface equipment (such as coiled tubing injector, mud pump, and flowback equipment), to maintain the bottomhole pressure within a desired pressure windows. In this manner the surface processing system 42 operates to coordinate control between coiled tubing 20 and UBD/MPD equipment to manage the bottomhole pressure).

In other embodiments, the surface processing system 42 operates to automatically execute a drilling plan or a sequence of driller instructions without human intervention. These instructions can include, for example, cruise control (e.g., to maintain certain tripping speed), automatic reduction of the tripping speed, for example, due to a restriction, or to change the tripping speed to protect downhole motor (e.g., as a result of rubber explosive decompression).

It will be understood that the present disclosure includes numerous embodiments. These embodiments include, but are not limited to, the following embodiments.

In a first embodiment, a device comprises a first end configured to be disposed downstream of a bottom hole assembly of a coiled tubing drilling string; a second end configured to be disposed downstream of the first end and upstream of a drive of the coiled tubing drilling string; and a moveable valve configured to move from a first position to a second position to divert at least a portion of drilling fluid flow away from the drive when the drilling fluid flow is greater than a preset flow value or a weight on bit is less than a preset weight value and thereby reduce a rotation rate of the drive.

A second embodiment may include the first embodiment, wherein the moveable valve comprises a piston in a mandrel; and the piston is configured to move from the first position to the second position when the drilling fluid flow is increased above the preset flow value.

A third embodiment may include the second embodiment, wherein the piston is spring biased into the first position.

A fourth embodiment may include the third embodiment, further comprising a J-slot mechanism between the piston and the mandrel, wherein the J-slot mechanism is configured to secure the piston in the second position after the drilling fluid flow is temporarily increased above the preset flow value a first time and to release the piston from the second position after the drilling fluid flow is temporarily increased above the preset flow value a second time.

A fifth embodiment may include any one of the second through fourth embodiments, wherein the piston comprises first ports that are aligned with corresponding mandrel ports when the piston is in the second position; and said alignment of the first ports and the corresponding mandrel ports vents drilling fluid through the piston and the mandrel thereby bypassing the drive.

A sixth embodiment may include any one of the second through fifth embodiments, wherein the piston comprises second ports on a downstream end thereof, the second ports providing a fluid passageway through the piston to the drive when the piston is in the first position.

A seventh embodiment may include the sixth embodiment, wherein the piston comprises a plug on the downstream end thereof sized and shaped to engage a corresponding plug seat on an inner wall of the mandrel when the piston is in the second position; and said engagement of the plug with the plug seat restricts the fluid passageway thereby reducing fluid flow to the drive.

An eighth embodiment may include any one of the second through seventh embodiments, wherein the piston is spring biased into the first position; the piston comprises first ports that are aligned with corresponding mandrel ports when the piston is in the second position, said alignment of the first ports and the corresponding mandrel ports vents drilling fluid through the piston and the mandrel thereby bypassing the drive; the piston comprises second ports on a downstream end thereof, the second ports providing a fluid passageway through the piston to the drive when the piston is in the first position; the piston comprises a plug on the downstream end thereof sized and shaped to engage a corresponding plug seat on an inner wall of the mandrel when the piston is in the second position, said engagement of the plug with the plug seat restricts the fluid passageway thereby reducing fluid flow to the drive; and wherein the device further comprises a J-slot mechanism between the piston and the mandrel, wherein the J-slot mechanism is configured to secure the piston in the second position after the drilling fluid flow is temporarily increased above the preset flow value a first time and to release the piston from the second position after the drilling fluid flow is temporarily increased above the preset flow value a second time.

A ninth embodiment may include the first embodiment, further comprising a first mandrel comprising the first end; a second mandrel comprising the second end; and wherein the second mandrel is configured to move in the upstream direction with respect to the second mandrel from the first position to the second position.

A tenth embodiment may include the ninth embodiment, wherein the second mandrel is spring biased into the second position.

An eleventh embodiment may include the tenth embodiment, further comprising a spring deployed between an upper shoulder of the second mandrel and a lower shoulder of the first mandrel.

A twelfth embodiment may include any one of the tenth through eleventh embodiments, wherein the spring is configured to secure the second mandrel in the second position when the weight on bit less than the preset weight value; and allow the second mandrel to move from the second position to the first position when the weight on bit greater than the preset weight value.

A thirteenth embodiment may include any one of the ninth through twelfth embodiments, wherein the first mandrel comprises ports that vent drilling fluid through the first mandrel when the second mandrel is in the second position thereby bypassing the drive.

A fourteenth embodiment may include the thirteenth embodiment, wherein the second mandrel comprises an upper shoulder that blocks the ports in the first mandrel when the second mandrel is in the second position thereby routing fluid to the drive.

A fifteenth embodiment may include any one of the ninth through fourteenth embodiments, wherein the first mandrel comprises ports that vent drilling fluid through the first mandrel when the second mandrel is in the second position thereby bypassing the drive; the second mandrel comprises an upper shoulder that blocks the ports in the first mandrel when the second mandrel is in the second position thereby routing fluid to the drive; wherein the device further comprises a spring deployed between the upper shoulder of the second mandrel and a lower shoulder of the first mandrel and that biases the second mandrel into the second position; and wherein the spring is configured to secure the second mandrel in the second position when the weight on bit less than the preset weight value and allow the second mandrel to move from the second position to the first position when the weight on bit greater than the preset weight value.

In a sixteenth embodiment a method for diverting drilling fluid flow away from a drive in a coiled tubing drilling operation comprises deploying a coiled tubing drill string in a wellbore, the coiled tubing drill string including a moveable valve deployed between a bottom hole assembly a drive of the coiled tubing drilling string; circulating drilling fluid through the coiled tubing drill string and applying weight on bit to the coiled tubing drill string to drill the wellbore; and temporarily increasing a drilling fluid flow rate above a preset flow value or decreasing the applied weight on bit below a preset weight value to divert at least a portion of drilling fluid flow away from the drive and reduce a rotation rate of the drive.

A seventeenth embodiment may include the sixteenth embodiment, wherein the increasing the drilling fluid flow rate above the preset flow value or decreasing the applied weight on bit below the preset weight value causes the moveable valve to move from a first position to a second position and thereby divert the drilling fluid flow.

An eighteenth embodiment may include the seventeenth embodiment, wherein the increasing the drilling fluid flow rate above the preset flow value or decreasing the applied weight on bit below the preset weight value overcomes a spring bias.

A nineteenth embodiment may include any one of the sixteenth through eighteenth embodiments, further comprising temporarily increasing the drilling fluid flow rate above the preset flow value a second time to return the drilling fluid flow to the drive.

A twentieth embodiment may include any one of the sixteenth through eighteenth embodiments, further comprising increasing the applied weight on bit above the preset weight value to return the drilling fluid flow to the drive.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform] ing [a function] . . . " or "step for [perform] ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A device, comprising:

a first mandrel comprising a first end, the first end configured to be disposed downstream of a bottom hole assembly of a coiled tubing drilling string;

a second mandrel comprising a first end and a second end, the first end comprising a piston functioning as a port, and the second end configured to be disposed downstream of the first end and upstream of a drive of the coiled tubing drilling string;

wherein the second mandrel is configured to move in the upstream direction with respect to the first mandrel from a first position to a second position, and wherein the device is configured to divert at least a portion of drilling fluid flow away from the drive when a weight on bit is less than a preset weight value and thereby reduce a rotation rate of the drive.

2. The device of claim 1, wherein the second mandrel is spring biased into the first position.

3. The device of claim 2, further comprising a spring deployed between an upper shoulder of the second mandrel and a lower shoulder of the first mandrel.

4. The device of claim 3, wherein the spring is configured to:

secure the second mandrel in the first position when the weight on bit is less than the preset weight value; and allow the second mandrel to move from the first position to the second position when the weight on bit greater than the preset weight value.

5. The device of claim 1, wherein the first mandrel comprises ports that vent drilling fluid through the first mandrel when the second mandrel is in the first position thereby bypassing the drive.

6. The device of claim 5, wherein the second mandrel comprises an upper shoulder that blocks the ports in the first mandrel when the second mandrel is in the second position thereby routing fluid to the drive.

7. The device of claim 1, wherein:

the first mandrel comprises ports that vent drilling fluid through the first mandrel when the second mandrel is in the first position thereby bypassing the drive;

the second mandrel comprises an upper shoulder that blocks the ports in the first mandrel when the second mandrel is in the second position thereby routing fluid to the drive;

wherein the device further comprises a spring deployed between the upper shoulder of the second mandrel and a lower shoulder of the first mandrel and that biases the second mandrel into the first position; and wherein the spring is configured to secure the second mandrel in the first position when the weight on bit is less than the preset weight value and allow the second mandrel to move from the first position to the second position when the weight on bit greater than the preset weight value.

* * * * *